US005860374A

United States Patent [19]

Jensen et al.

[11] Patent Number: 5,860,374

[45] Date of Patent: Jan. 19, 1999

[54] AUTOMATIC FEED SYSTEM FOR EMBROIDERY MACHINE

[75] Inventors: Lars D. Jensen, Arlington; Larry C. Lawley, Weatherfoord, both of Tex.

[73] Assignee: Data-Stitch, Inc., Aledo, Tex.

[21] Appl. No.: 805,310

[22] Filed: Feb. 25, 1997

[51] Int. Cl.[6] ..... D05B 21/00; D05C 5/02; D05C 9/06

[52] U.S. Cl. ..... 112/102.5; 112/475.07; 112/470.14; 38/102.2

[58] Field of Search ..... 112/102.5, 103, 112/470.06, 470.14, 475.07, 475.18, 475.19, 470.18; 38/102.2

[56] References Cited

U.S. PATENT DOCUMENTS 3,938,453 2/1976 Muller .
4,003,322 1/1977 Yanikoski ..... 112/102.5
4,411,208 10/1983 Nishida et al. .
4,708,073 11/1987 Kellogg et al. ..... 112/475.07
5,413,057 5/1995 Moore, III .
5,421,277 6/1995 Conley, Jr. et al. ..... 112/102.5
5,603,270 2/1997 White et al. ..... 112/475.07 X

*Primary Examiner*—Peter Nerbun
*Attorney, Agent, or Firm*—James E. Bradley

[57] ABSTRACT

A stitching machine has a stitching head stationarily mounted above the table. A carriage frame is mounted above the table and below the head for movement in a Y-direction relative to the head. A carriage belt is rotatably mounted to the carriage frame for movement in an X-direction relative to the head and the carriage frame. The carriage belt and carriage frame are controlled by a computer. A plurality of cartridges are employed, each cartridge having a hoop for holding a tautly mounted fabric workpiece. A latch is mounted to the belt for engaging one of the cartridges for movement with the belt to perform stitching. A magazine holds a plurality of the cartridges and advances them automatically one at a time onto the table for engagement with the latch after the previous cartridge has been released by the latch.

32 Claims, 7 Drawing Sheets

AUTOMATIC FEED SYSTEM FOR EMBROIDERY MACHINE

TECHNICAL FIELD

This invention relates in general to automated embroidery machines and in particular to a system for automatically feeding workpieces to the embroidery machine.

BACKGROUND ART

This invention deals with automatic embroidery machines for stitching logos, patches, monograms and the like. These embroidery machines are operated by a computer or controller which is programmed to stitch the design in the desired colors. These machines have one or more heads mounted over a table. The operator will secure the workpiece, which may be a shirt, jacket, cap, patch or the like, to a frame such as a hoop. The hoop attaches to a carriage mounted at table level. The carriage has a computer controlled drive mechanism that moves the hoop over the table while the stitching is being performed. After each workpiece is stitched, the operator removes the workpiece from the hoop and attaches another. Usually a number of identical workpieces are to be made, and the number may be quite large.

The operator has to maintain close watch on the machine because of having to remove the workpiece once finished and install another. During the stitching time, which can be several minutes with complex designs, the operator is free to perform other tasks. However, this short amount of time may not be enough to perform any useful tasks. It is difficult for one person to handle the workpiece feeding process for more than one machine because of the timing. This results in lost time for the worker, decreasing productivity.

DISCLOSURE OF INVENTION

In this invention, an automatic feeder mechanism is employed with a conventional embroidery machine. The embroidery machine has a stitching head stationarily mounted above the table. A carriage frame is mounted above the table and below the head for movement in a Y-direction relative to the head. A carriage belt is rotatably mounted to the carriage frame for movement in an X-direction relative to the head and the carriage frame. The carriage belt and carriage frame are controlled by a computer.

A plurality of cartridges are employed, each cartridge having a hoop for holding a tautly mounted fabric workpiece. A latch is mounted to the belt for engaging one of the cartridges for movement with the belt to perform stitching. A magazine holds a plurality of the cartridges next to the table and advances them automatically one at a time onto the table for engagement with the latch after the previous cartridge has been released by the latch.

BEST MODE FOR CARRYING OUT THE INVENTION

Figure 1:
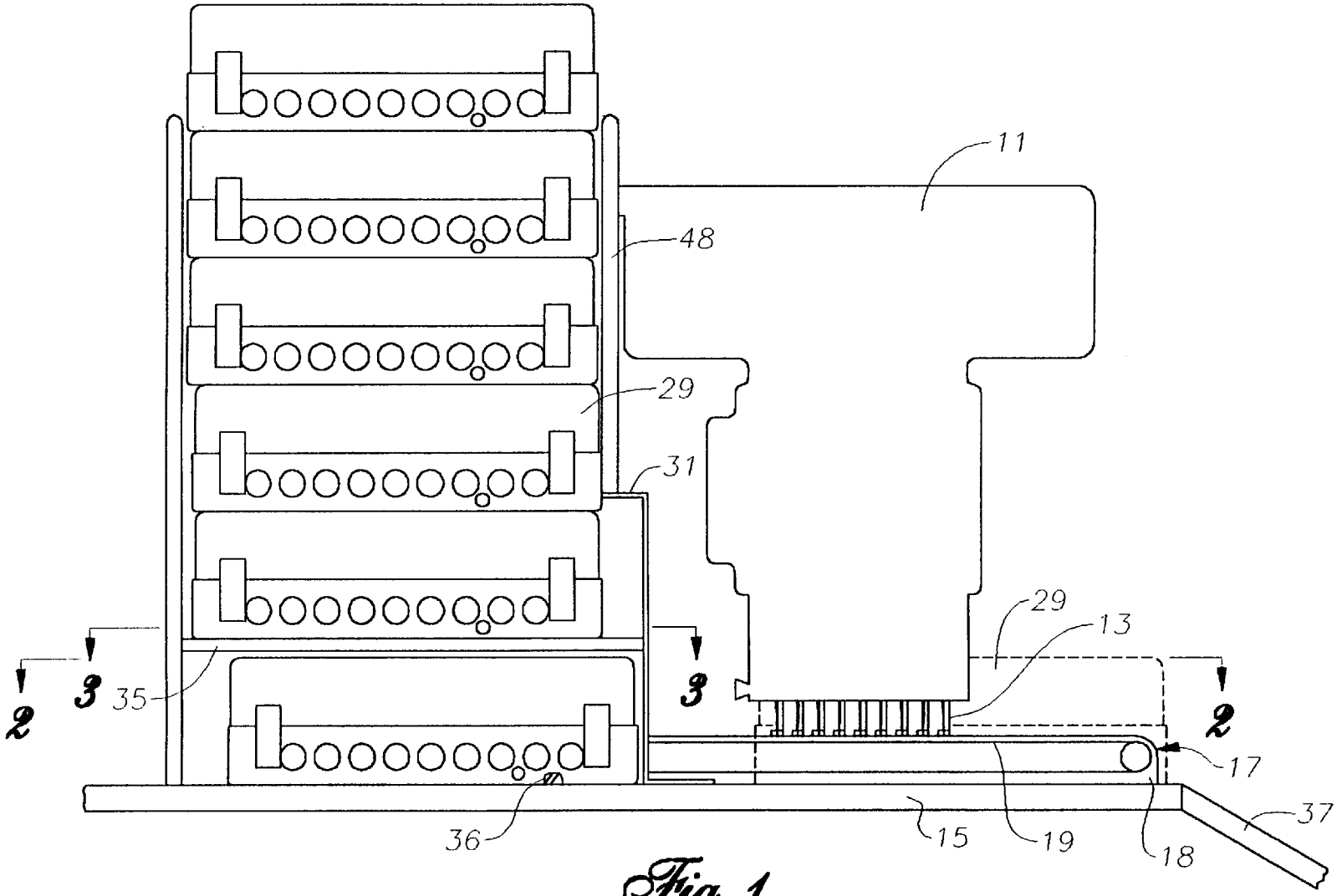
FIG. 1 is a schematic front elevational view illustrating an embroidery machine with an automatic feed attachment in accordance with this invention.

Referring to FIG. 1, the embroidery machine has one or more heads 11. Head 11 is controlled by a computer (not shown) and has a plurality of needles 13. Needles 13 will be threaded with different colors of threads. Head 11 is stationarily mounted to and above a table 15.

Figure 2:
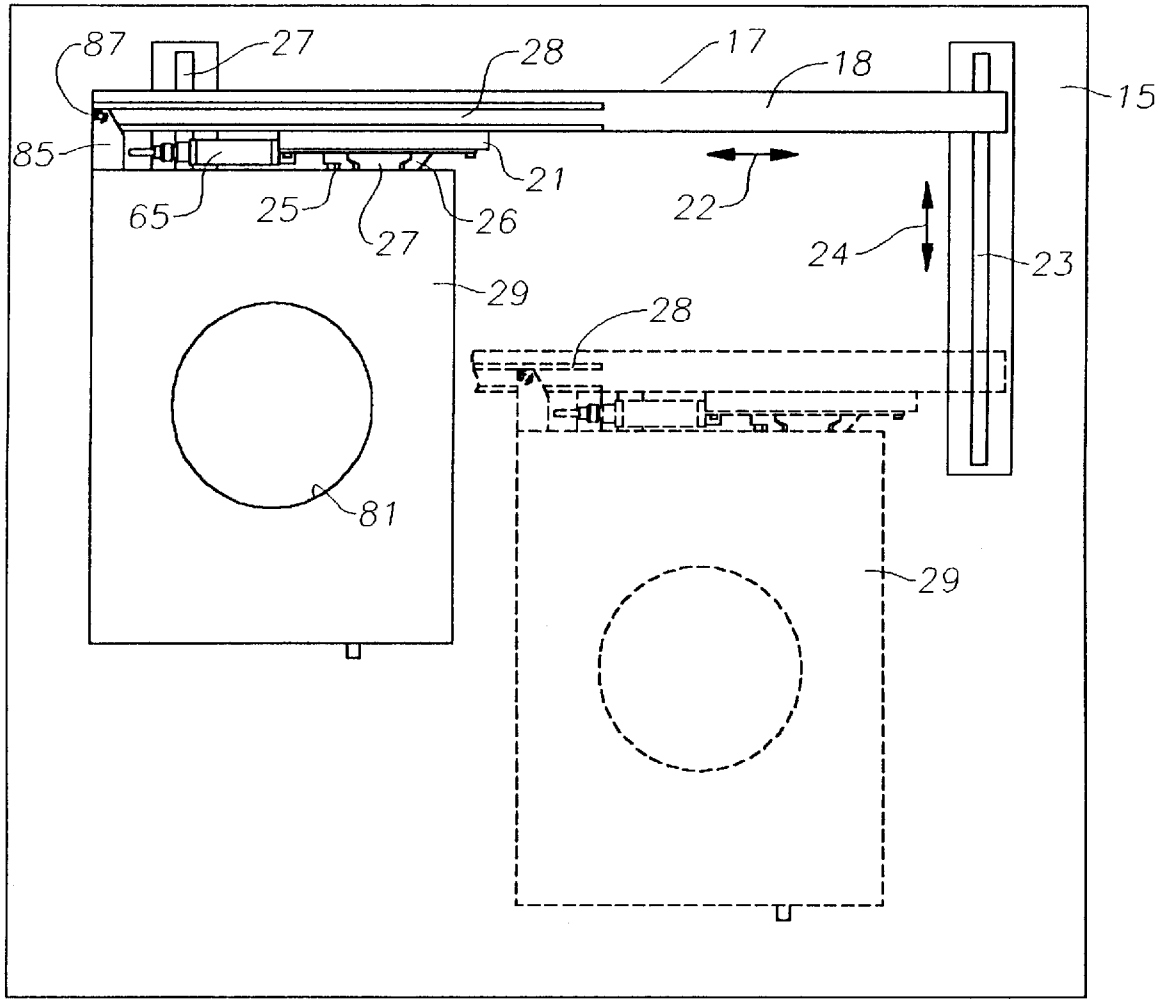
FIG. 2 is a schematic view of the automatic feed system of FIG. 1, taken along line II—II, with portions removed for clarity.

A carriage 17 is mounted below and rearward of head 11 slightly above table level. Carriage 17 is a mechanism that locates below head 11 for moving the workpiece in X and Y directions in response to signals from the computer. Carriage 17 has a carriage frame 18 which encloses a transverse belt 19. Carriage frame 18 is an elongated metal housing. A latch 21 (FIG. 2) is mounted to belt 19 for movement therewith. Signals from the computer rotate belt 19 and thus move latch 21 in an X direction as indicated by arrows 22. As shown in FIG. 2, a pair of guide rods 23 extend perpendicular to and support carriage frame 18. Carriage frame 18 will move along guide rods 23 in the Y direction as indicated by arrows 24. Another belt (not shown) perpendicular to belt 19 moves carriage frame 18 in the Y direction along guide rods 23. A pair of parallel guide rails 28 are rigidly mounted on an upper side of carriage frame 18 for a purpose that will be subsequently explained.

Latch 21 has a pair of movable jaws 25, 26 which engage a lug 27 on a cartridge 29. Cartridge 29 contains the workpiece, such as a patch, shirt or portion of a cap, which will be stitched. The dotted lines indicate that carriage 17 will slide cartridge 29 in the X and Y directions on table 15 in response to the computer signals to perform stitching.

Referring again to FIG. 1, a number of cartridges 29 will be stacked in a magazine 31 located adjacent to head 11. Head 11 will be operating on one cartridge 29 while the other cartridges 29 will be waiting their turn. A separate workpiece will be contained in each cartridge 29. Magazine 31 has a plurality of vertical rods 33 that provide lateral support to the stack of cartridges 29. The second cartridge 29 from the bottom is located on a shelf 35 which is supported above table 15 at a fixed distance greater the height of the cartridge 29. The distance of the shelf 35 allows the cartridge 29 in the lowermost position on table 15 to be moved away from magazine 31 by carriage 17. The remaining cartridges 29 rest on top of the second cartridge 29.

The first cartridge 29 is located below shelf 35 in position to be secured to carriage 17 by latch 21 (FIG. 2). A stop 36 limits forward movement of cartridge 29 when contacted by latch 21. After belt 19 latches to the first cartridge 29, carriage 17 will move it over under head 11. During this process, the first cartridge 29 will push the completed cartridge 29, if any, off table 15 and down a ramp 37 for further processing.

Figure 3:
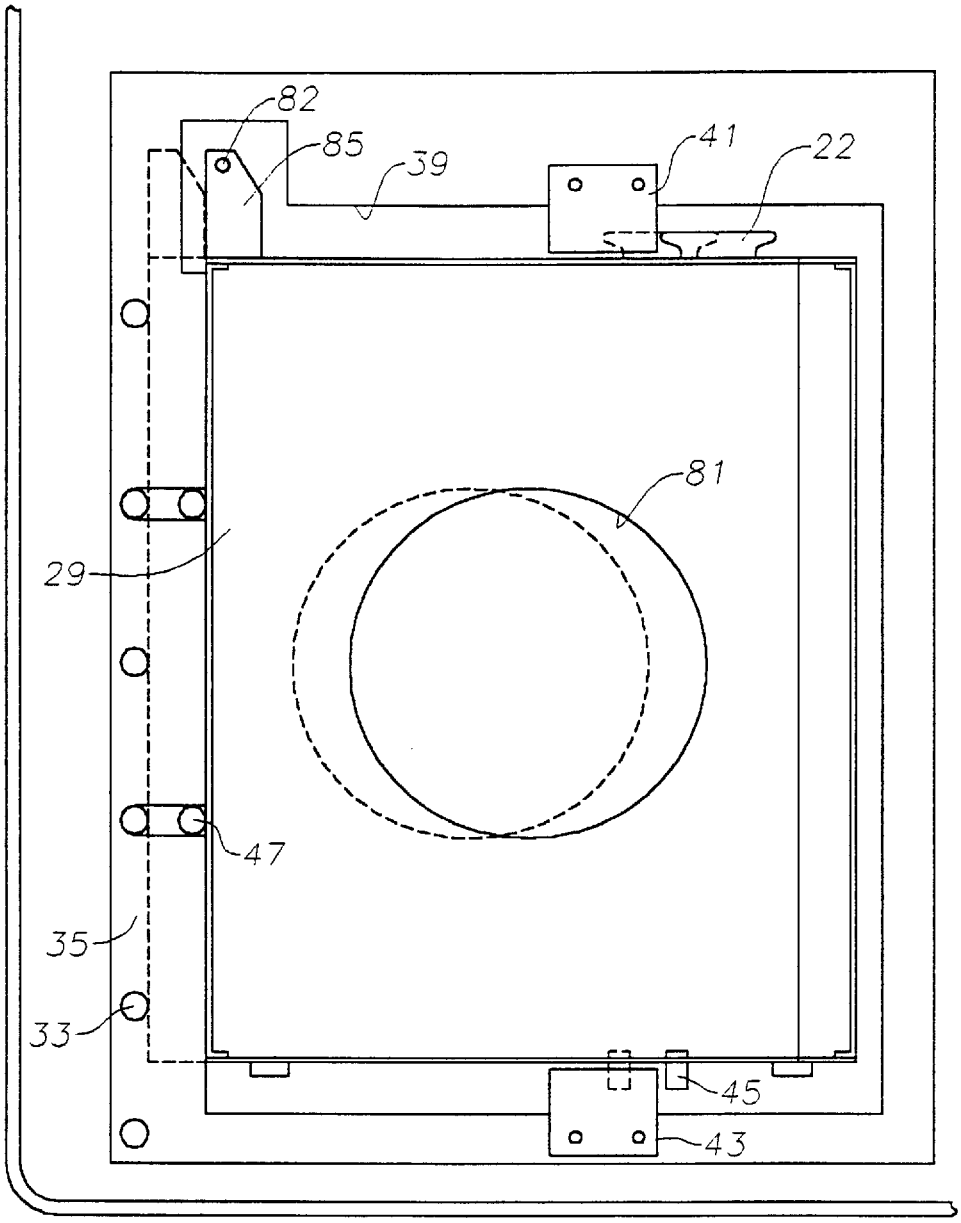
FIG. 3 is a sectional view of a portion of the automatic feed system of FIG. 1, taken along the line III—III of FIG. 1.

Referring to FIG. 3, shelf 35 has a generally rectangular aperture 39 through it, which has larger dimensions than cartridge 29 to allow cartridges 29 to drop through aperture 39. Aperture 39 has a rearward tab 41 and a forward tab 43 that protrude into aperture 39. In the storage position, indicated by the dotted lines, lug 27 on cartridge 29 will rest on rearward tab 41 for support on shelf 35, a pin 45 on the forward side of cartridge 29 will rest on forward tab 43, and the outboard edge of cartridge 29 adjacent to pivot rods 47 rests on shelf 35. In the storage position indicated by the dotted lines, the cartridge 29 located on shelf 35 will support all of the cartridges 29 located above it, with four being shown in the embodiment of FIG. 1.

Figure 4:
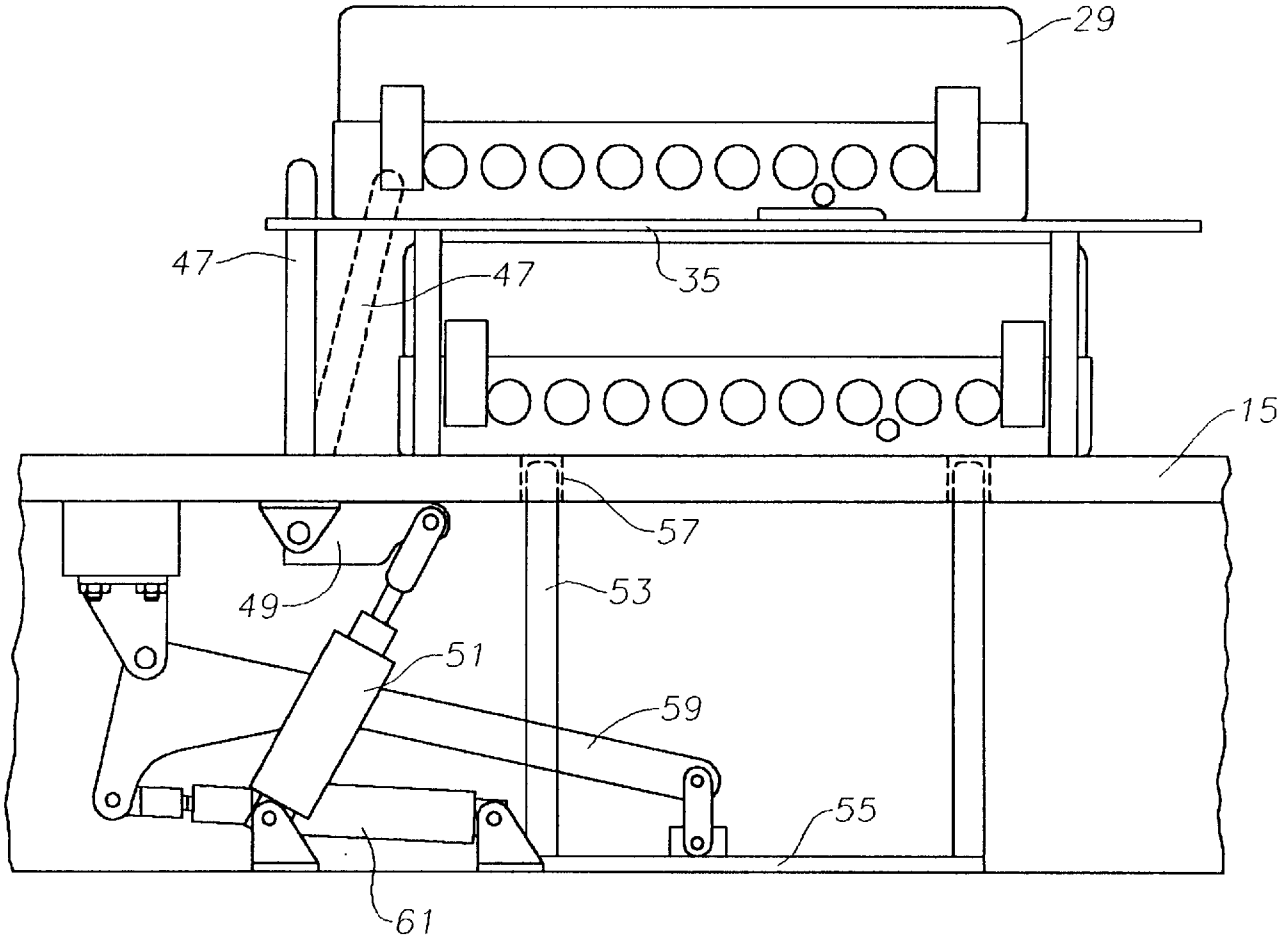
FIG. 4 is a schematic front elevational view of the automatic feed system of FIG. 1, showing means for feeding additional cartridges from the magazine.

A pair of pivot rods 47 when actuated will push the cartridge 29 located on shelf 35 laterally inboard as indicated by the solid line position. In the solid line position, cartridge 29 will be aligned with aperture 39 and will be free to move downward through aperture 39. This will not occur until the cartridge 29 on table 15 below shelf 35 (FIG. 1) has been moved by carriage 17 away from magazine 31. The vertical rods 33 include a plurality of inboard vertical rods 48 which laterally support only the cartridges 29 located above the second cartridge 29. Consequently, lateral movement by pivot rods 47 moves only the second cartridge 29 and not any of those stacked above, as these are held by the inboard vertical rods 48. Referring to FIG. 4, the mechanism for pivoting pivot rods 47 includes a crank arm 49 and an air cylinder 51. When actuated, air cylinder 51 will rotate crank arm 49, causing pivot rods 47 to pivot to the dotted line position shown in FIG. 4.

Figure 5:
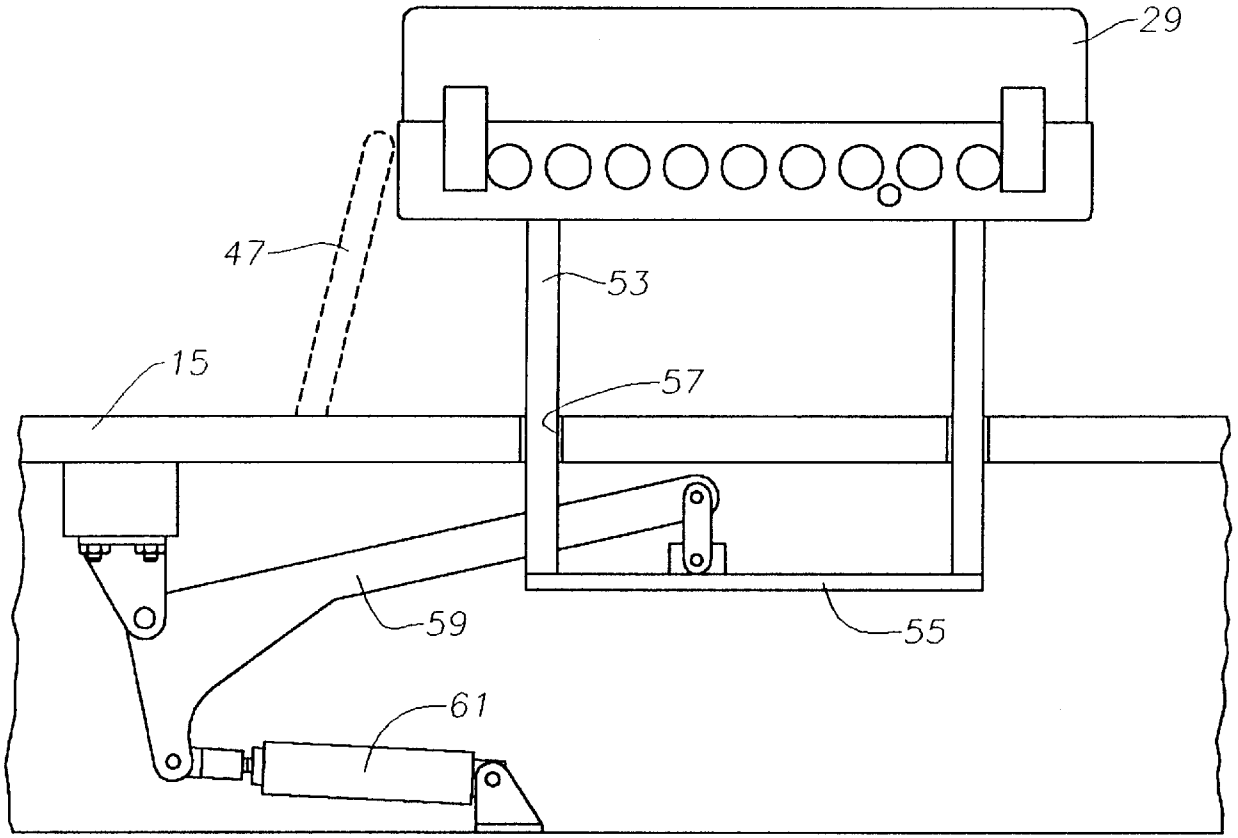
FIG. 5 is another schematic view of the automatic feed system as shown in FIG. 4, with portions removed, and with the dampener shown in an upper position.

The weight of several cartridges 29 can be significant. To prevent damage due to dropping onto table 15, a dampener mechanism cushions the freefall of cartridges 29 through shelf aperture 39. The dampener comprises a plurality of shock absorber rods 53, preferably four. Rods 53 are mounted to a movable plate 55 and extend through holes 57 in table 15. Before pivot rods 47 are stroked to the dotted line position, shock absorber rods 53 (only 2 shown) will be raised to the elevated position shown in FIG. 5 in contact with the bottom of the second cartridge 29. This is handled preferably through limit switches (not shown) being contacted by the first cartridge 29 when it is initially moved from magazine 31 over to beneath head 11. Plate 55 is mounted to a crank arm 59 which in turn is pivoted by an air cylinder 61. Air cylinder 61 will be signalled by the limit switches. When lowering the cartridges 29 from the position shown in FIG. 5 to a position with the lower one in contact with table 15, shown in FIG. 4, cylinder 61 may be powered down, or restrictive orifices may be utilized to provide a gradual descent.

Figure 6:
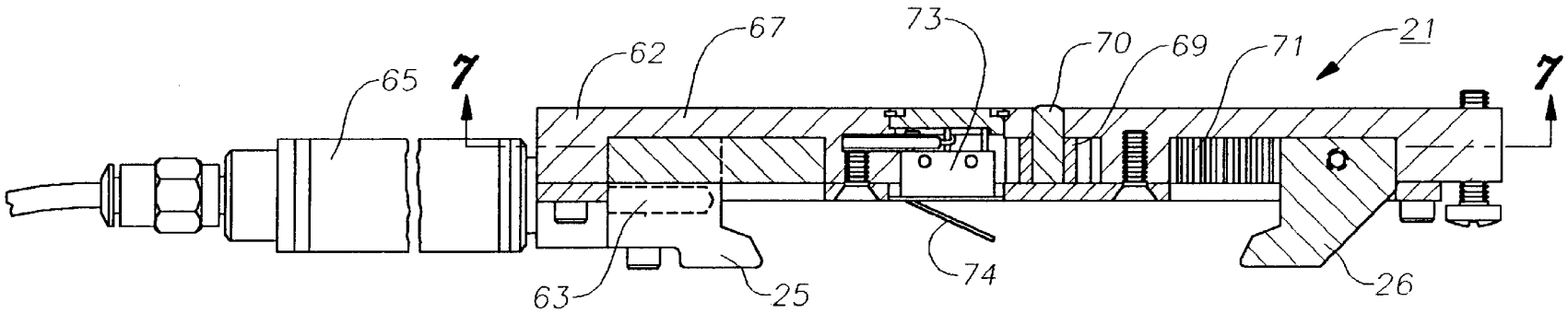
FIG. 6 is an enlarged sectional view of the latch for latching the cartridges to the automatic feed system of FIG. 1.
Figure 7:
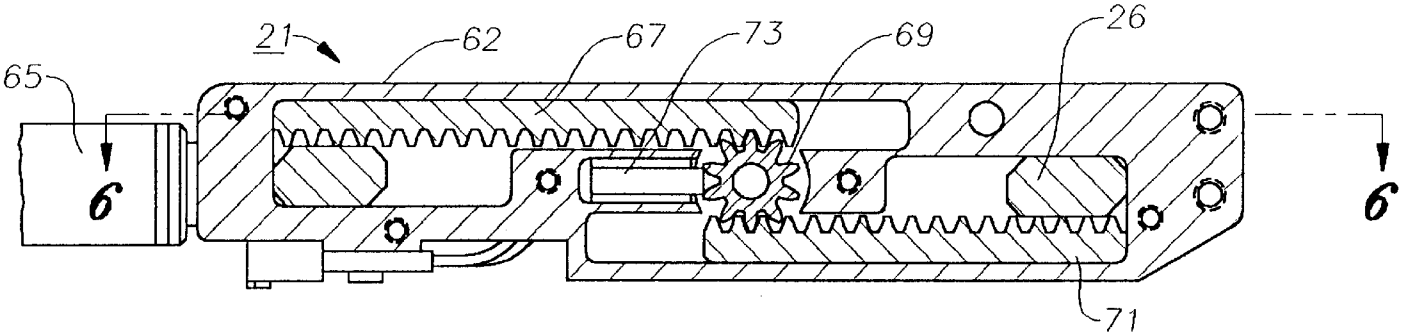
FIG. 7 is a sectional view of the latch of FIG. 6, taken along the line VII—VII of FIG. 6.

FIG. 6 illustrates details of the latch 21 (FIG. 1). Latch 21 has a body 62 that is secured by screws to a bracket (not shown) mounted on transverse belt 19 (FIG. 1). A plunger 63 extends through a portion of the left side of body 62. Plunger 63 is stroked by an air cylinder 65. Plunger 63 is mounted to jaw 25 to move jaw 25 when air cylinder 65 strokes. A rack 67 is mounted to jaw 25 for movement therewith. Rack 67 has teeth which engage a pinion 69. Pinion 69 is stationarily but rotatably mounted to latch body 62 by a pin 70. Pinion 69 drives another rack 71. Jaw 26 is mounted to rack 71 for movement therewith.

A switch 73 having an actuator 74 protruding forward is mounted to body 62. Switch 73 is an electrical switch that controls air cylinder 65. When moving carriage 17 and latch 21 toward a cartridge 29 in the Y direction, actuator 74 will press against lug 27 (FIG. 2), causing switch 73 to signal air cylinder 65. Stop 36 prevents the cartridge 29 from moving forward out of the gripping range of jaws 25, 26 when lug 27 contacts switch 73. Switch 73 causes jaws 25, 26 to move toward each other to grip lug 27 (FIG. 2). Air cylinder 65 strokes in a reverse direction to move jaws 25, 26 apart when provided with another signal from another limit switch placed in the appropriate position (not shown) to be contacted after head 11 has performed the stitching.

Figure 8:
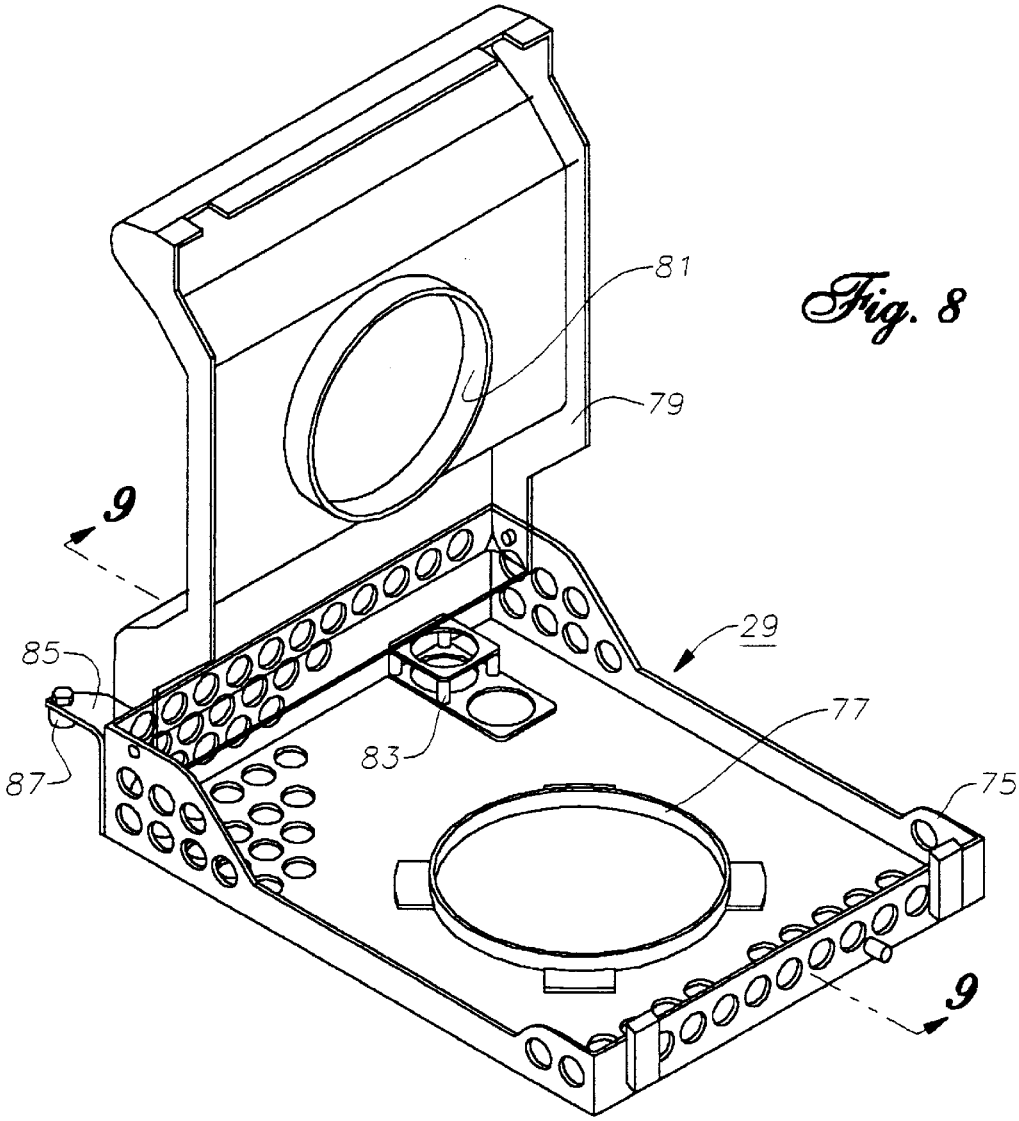
FIGS. 8 and 9 each show an individual cartridge.
Figure 9:
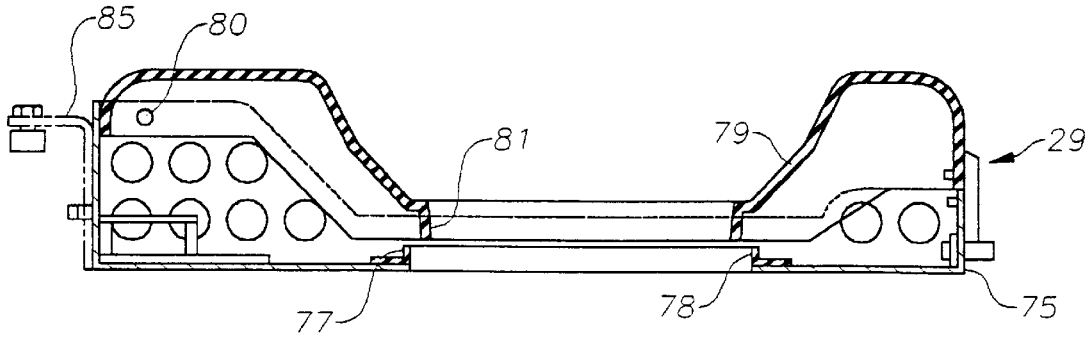

FIGS. 8 and 9 illustrate the cartridge 29. Cartridge 29 includes a metal tray 75 which serves as the bottom. The holes illustrated in FIGS. 1, 4 and 5 that are contained in tray 75 are not shown in FIG. 8 and are used to reduce the weight. Tray 75 has a hole in its bottom encircled by a first or outer hoop 77. Outer hoop 77 is secured to the bottom of tray 75 and protrudes upward. The workpiece (not shown), which will be fabric of some type, will be positioned over outer hoop 77 and stretched and secured by a second or inner hoop 78 (not shown) in a conventional manner. Inner hoop 78 has a slightly smaller diameter than outer hoop 77 so that the hoops closely engage one another. Inner hoop 78 is press fit inside outer hoop 77 after the workpiece is positioned over outer hoop 77 so that the workpiece is tautly held therebetween. A clear, plastic lid 79 is secured by hinges 80 to tray 75. Lid 79 has a hole 81 through it for the passage of needles 13 (FIG. 1). The central portion of lid 79 is at a lower height than the forward and rearward portions so as to slide under needles 13 when carriage 17 moves it under or out from under head 11. For additional stiffness, a lug support 83 is bolted to the bottom of tray 75. Lug support 83 has a portion which protrudes through a hole in tray 75 and is integrally formed with lug 27 (FIG. 3). A bracket 85 extends from rearward outboard corner of tray 75. A bearing 87 is mounted to a shaft extending downward from bracket 85. Bearing 87 locates between guide rails 38 (FIG. 2) on top of carriage 17 when cartridge 29 is engaged by latch 21. Bracket 85 and bearing 87 serve as an arm protruding from tray 75 to stabilize tray 75 against any pivotal movement relative to carriage frame 18. In operation, the user will place the fabric over outer hoop 77 and secures it by an inner hoop. The user tucks the fabric within tray 75 and closes lid 79 (FIG. 9). The user will stack the cartridges 29 in a prestaging position in magazine 31, as shown in FIG. 1. The lowermost cartridge 29 will be resting on table 15 in a staging position. The user actuates the computer of the embroidery machine, which will signal carriage 17 to move latch 21 over to the lowermost cartridge 29 as shown in FIG. 2. As the computer moves carriage 17 in a forward direction, switch actuator 74 (FIG. 6) will be depressed by lug 27 (FIG. 2), signalling air cylinder 65 to close jaws 25, 26 around lug 27. A limit switch then signals carriage 17 to move the lowermost carriage 29 over to a position under head 11, engaging bearing 87 in guide rails 28 while doing so, generally as illustrated by the dotted lines of FIG. 2.

As latch 21, lug 27 and cartridge 29 move inboard toward the head 11, but prior to the hole 81 entering the working area of the head 11, bearing 87 reversibly enters guide rails 28, which are fixedly mounted to carriage frame 18. The guide rails 28 allow free movement of the cartridge 29 in the Y direction relative to carriage frame 18, but none in the X direction until the cartridge 29 is pushed out from under head 11 and down ramp 37. Guide rails 28 provide resistance to undesirable pivotal rotation of the cartridge 29 about the lug 27 when force is applied to the cartridge 29 via the latch 21. Head 11 will perform the stitching with needles 13 by moving cartridge 29 as indicated by arrows 22, 24 in the X and Y directions.

While the lowermost cartridge 29 is being moved from the magazine 31 to under head 11, it will be moved in contact with a limit switch (not shown). This will signal the automatic feed system that the lowermost cartridge 29 has been moved from magazine 31. This first signals air cylinder 61 (FIGS. 4, 5) to raise shock absorber rods 53 to the upper position shown in FIG. 5. In the upper position, shock absorber rods 53 will be located substantially in contact with the bottom of the second cartridge 29, with the other cartridges 29 being supported on top of the second cartridge 29. Then, air cylinder 51 (FIG. 4) will rotate pivot or push rods 47, causing them to push the second cartridge 29 from the shelf 35. Second cartridge 29 will now be aligned with aperture 39 and supported by shock absorber rods 53. Shock absorber rods 53 serve as an elevator to gradually lower the second cartridge 29 until it contacts table 15 and is in the staging position. The third cartridge 29, as shown in FIG. 1, simultaneously lowers down onto shelf 35 for support. The fourth, fifth and sixth cartridges simultaneously move downward with and rest on top of the third cartridge 29, which will now be on shelf 35.

Once stitching on a workpiece in a cartridge 29 has been completed by head 11, jaws 25, 26 will release it. Head 11 will then move over, disengaging bearing 87 from guide rails 28, and repeat the process with the cartridge 29 located below shelf 35. When the new cartridge 29 is moved over under head 11, it will push the completed cartridge 29 off ramp 37.

The invention has significant advantages. After an operator loads a magazine, he is free until the entire magazine has been stitched. This additional free time can be utilized in productive ways. For example, an operator could operate several machines equipment with loading systems as described. The system increases productivity.

While the invention has been shown in only one of is forms, it should be apparent to those skilled in the art that it is not so limited but is susceptible to changes without departing from the scope of the invention. For example, rather than causing the cartridges to move downward in the magazine by gravity, the magazine could feed the cartridges upward to the table. A worm gear arrangement could be utilized to move the cartridges upward. The cartridges could be configured to hold caps, with the magazine operating in a generally circular pattern.

We claim:

1. A stitching machine, comprising in combination:

a table;

a stitching head mounted stationarily above the table and including a stitching needle;

a plurality of cartridges;

each cartridge having means for holding a fabric workpiece; carriage means for positioning one of the cartridges on the table below the head and moving the cartridge on the table transversely to the head, such that the stitching head can stitch the fabric workpiece mounted to the cartridge;

a latch fixedly mounted to the carriage means for reversibly attaching the cartridge to the carriage means; and feeder means for feeding the cartridges to a staging position on the table for engagement with the latch.

2. The stitching machine of claim 1, wherein each of the cartridges comprises:

a tray having at least two upright sidewalls.

3. The stitching machine of claim 1, wherein each of the cartridges comprises:

a tray having at least two upright sidewalls; and a cover having a central aperture for exposing the fabric workpiece such that the needle of the stitching head may pass through the aperture to stitch the fabric workpiece.

4. The stitching machine of claim 1, wherein each of the cartridges comprises:

a tray having at least two upright sidewalls;

a cover having a central aperture for exposing the workpiece such that the needle of the stitching head may pass through the aperture to stitch the fabric workpiece;

a fabric hoop rigidly mounted to the cartridge for tautly mounting the fabric workpiece; and the cover being movable between a closed and an open position to allow access to the fabric hoop.

5. The stitching machine of claim 1, wherein each of the cartridges has a lug for engagement by the latch.

6. The stitching machine of claim 1, wherein each of the cartridges comprises:

a tray;

a lug protruding from a rearward portion of the tray for engagement with the latch; and an arm protruding from the rearward portion of the tray for sliding engagement with the carriage means.

7. The stitching machine of claim 1, wherein the feeder means comprises:

a magazine for holding a plurality of the cartridges in a prestaging position adjacent to the table prior to movement to the staging position; and the magazine having means for moving the cartridges one at a time from the prestaging position to the staging position.

8. The stitching machine of claim 1, wherein the feeder means comprises:

a magazine for holding a plurality of the cartridges in a vertical array adjacent to the table; and the magazine having means for moving the cartridges vertically from the magazine to the staging position on the table for engagement by the latch.

9. The stitching machine of claim 1, wherein the feeder means comprises:

a magazine for holding a plurality of the cartridges in a vertical stack above the table in a prestaging position; and the magazine having means for lowering the cartridges in the magazine from the prestaging position to the staging position on the table for engagement by the latch.

10. The stitching machine of claim 1, wherein the feeder means comprises:

a magazine having a shelf located above the table for holding a plurality of the cartridges in a stack; and means for lowering the cartridges one at a time from the shelf into the staging position on the table; and wherein the latch is moved by the carriage means into engagement with one of the cartridges while located in the staging position.

11. The stitching machine of claim 1, wherein the latch comprises:

a pair of gripping jaws; and actuating means for causing the jaws to move toward and away from each other between closed and open positions.

12. The stitching machine of claim 1, wherein the latch comprises:

a pair of gripping jaws; and actuating means for causing the jaws to move toward and away from each other between closed and open positions; and sensor means which senses proximity of the latch to a portion of one of the cartridges and activates the actuating means to move the jaws to the closed position.

13. A stitching machine, comprising in combination:

a table;

a stitching head stationarily mounted above the table and including a stitching needle;

a plurality of cartridges, each cartridge having a hoop for tautly holding a fabric workpiece;

a carriage frame mounted above the table and below the head for movement in a Y-direction relative to the head;

a carriage belt rotatably mounted to the carriage frame for movement in an X-direction relative to the head and the carriage frame;

a latch mounted to the belt for movement therewith for engaging one of the cartridges for movement with the belt to perform stitching and for releasing the cartridge from the belt once the stitching has been completed;

a magazine which holds a plurality of the cartridges; and the magazine having advancing means for automatically advancing one of the cartridges from the magazine to a staging position on the table for engagement with the latch after the previous cartridge has been released by the latch.

14. The stitching machine of claim 13, wherein each of the cartridges comprises:

a tray having a rearward end; and a lug protruding from the rearward end that is engageable by the latch.

15. The stitching machine of claim 13, wherein each of the cartridges comprises:

a tray having at least two upright sidewalls;

a cover having a central aperture for exposing the fabric workpiece such that the needle of the stitching head may pass through the aperture to stitch the fabric workpiece; and the cover being movable between a closed and an open position to allow access to the hoop.

16. The stitching machine of claim 13, further comprising a guide rail mounted to the carriage frame and extending in the X-direction; and wherein each of the cartridges comprises:

a tray;

a lug protruding from a rearward portion of the tray for engagement with the latch; and an arm protruding from the rearward portion of the tray for sliding engagement with the guide rail as the belt moves the tray relative to the carriage frame.

17. The stitching machine of claim 13, wherein:

the magazine holds the cartridges in a vertical array adjacent to the table; and the advancing means moves the cartridges vertically from the magazine to the staging position on the table for engagement by the latch.

18. The stitching machine of claim 13, wherein:

the magazine holds the cartridges in a vertical array above the table; and the advancing means moves the cartridges downward from the magazine to the staging position on the table for engagement by the latch.

19. The stitching machine of claim 13, wherein:

the magazine has a shelf located above the table for holding a plurality of the cartridges in a stack; and the advancing means lowers the cartridges one at a time from the shelf into the staging position on the table; and wherein the latch is moved by the carriage frame and the carriage belt into engagement with one of the cartridges while located in the staging position.

20. The stitching machine of claim 13, wherein:

the magazine has a shelf located above the table for holding a plurality of the cartridges in a stack, the shelf having a central opening sized to permit the cartridges to pass downward through the opening;

the advancing means comprises:

pushing means for pushing a lowermost one of the cartridges in the stack transversely on the shelf over the opening while the other cartridges in the stack are held by the magazine out of registry with the opening; and elevator means for lowering said lowermost one of the cartridges through the opening onto the table in the staging position on the table.

21. The stitching machine of claim 13, wherein the latch comprises:

a pair of gripping jaws; and actuating means for causing the jaws to move toward and away from each other between closed and open positions.

22. The stitching machine of claim 13, wherein the latch comprises:

a pair of gripping jaws; and actuating means for causing the jaws to move toward and away from each other between closed and open positions; and sensor means which senses proximity of the latch to a portion of one of the cartridges and activates the actuating means to move the jaws to the closed position.

23. A stitching machine, comprising in combination:

a table;

a stitching head stationarily mounted above the table and including a stitching needle;

a plurality of trays, each having a hoop for tautly holding a fabric workpiece;

a lug and an arm protruding from a rearward end of each of the trays;

a cover on each of the trays having a central aperture for exposing the fabric workpiece such that the needle of the stitching head may pass through the aperture to stitch the fabric workpiece, the cover being movable between a closed and an open position to allow access to the hoop;

a carriage frame mounted above the table and below the head for movement in a Y-direction relative to the head;

a guide rail mounted to the carriage frame for movement therewith, the guide rail extending in the X-direction for slidingly receiving the arm of one of the trays;

a carriage belt rotatably mounted to the carriage frame for movement in an X-direction relative to the head and the carriage frame;

a pair of gripping jaws mounted to the belt;

actuating means mounted to the belt for causing the jaws to move toward and away from each other between closed and open positions;

a sensor mounted to the belt which senses proximity of the jaws to the lug of one of the trays and activates the actuating means to move the jaws to the closed position;

a magazine which holds a plurality of the trays in a vertical array adjacent to the table; and the magazine having advancing means for automatically advancing one of the trays from the magazine to a staging position on the table for engagement with the latch after the previous tray has been released by the latch.

24. The stitching machine of claim 23, wherein:

the magazine holds the trays in the vertical array above the table; and the advancing means moves the trays downward from the magazine to the staging position on the table for engagement by the jaws.

25. A cartridge for holding a fabric workpiece for stitching operations, comprising:

a tray;

a first hoop mounted to and extending upward from the tray;

a second hoop for closely engaging the first hoop and holding a tautly mounted fabric workpiece therebetween; and a cover mounted to the tray, the cover having a central aperture for exposing the fabric workpiece such that a needle of a stitching head may pass through the aperture to stitch the fabric workpiece, the cover being movable between a closed and an open position to allow access to the hoops.

26. The cartridge according to claim 25, wherein the hoops register with the aperture.

27. The cartridge according to claim 26, wherein:

the hoops comprise circular walls;

the aperture of the cover is circular and registers with the hoops.

28. The cartridge according to claim 25, further comprising:

a wall extending upward from the tray along a perimeter of the tray, the wall defining a volume between the tray and the cover for containing fabric of the fabric workpiece that is located outside of the hoops.

29. A method of stitching a fabric workpiece with a stitching machine having a table, a stitching head mounted stationarily above the table and including at least one needle, a carriage frame mounted above the table and below the head for movement in a Y-direction relative to the head, and a carriage belt rotatably mounted to the carriage frame for movement in an X-direction relative to the head and the carriage frame, the carriage frame and carriage belt being controllable by a computer, the method comprising:

(a) securing a latch to the carriage belt;

(b) providing a plurality of cartridges;

(d) securing a fabric workpiece to each of the cartridges;

(e) storing the cartridges in a magazine adjacent to the table;

(f) feeding the cartridges one at a time from the magazine onto the table;

(g) latching the cartridge on the table to the latch and moving the cartridge on the table transversely to the head while stitching the fabric workpiece with the stitching head; then (h) releasing the cartridge from the latch once the stitching has been completed and repeating step (g) for the next cartridge.

30. The method according to claim 29, wherein step (g) comprises:

holding the cartridge on the table in a stationary position and moving the latch into engagement with the cartridge.

31. The method according to claim 29, wherein step (e) comprises storing the cartridges in a vertical array.

32. The method according to claim 29, wherein:

step (e) comprises storing the cartridges in a vertical array above the table; and step (f) comprises moving the cartridges downward onto the table.

* * * * *